US010987678B2

(12) United States Patent
Sato et al.

(10) Patent No.: US 10,987,678 B2
(45) Date of Patent: Apr. 27, 2021

(54) CENTRIFUGE AND CENTRIFUGE ROTOR FOR SUPPRESSING BUOYANCY

(71) Applicant: Eppendorf Himac Technologies Co., Ltd., Ibaraki (JP)

(72) Inventors: Jun Sato, Ibaraki (JP); Kenichi Nemoto, Ibaraki (JP)

(73) Assignee: Eppendorf Himac Technologies Co., Ltd., Ibaraki (JP)

( * ) Notice: Subject to any disclaimer, the term of this patent is extended or adjusted under 35 U.S.C. 154(b) by 467 days.

(21) Appl. No.: 15/779,089

(22) PCT Filed: Nov. 25, 2016

(86) PCT No.: PCT/JP2016/084950
§ 371 (c)(1),
(2) Date: May 25, 2018

(87) PCT Pub. No.: WO2017/090723
PCT Pub. Date: Jun. 1, 2017

(65) Prior Publication Data

US 2018/0353974 A1 Dec. 13, 2018

(30) Foreign Application Priority Data

Nov. 28, 2015 (JP) ..... JP2015-232496

(51) Int. Cl.
*B04B 7/06* (2006.01)
*B04B 5/04* (2006.01)
(Continued)

(52) U.S. Cl.
CPC ..... *B04B 7/06* (2013.01); *B04B 5/02* (2013.01); *B04B 5/0414* (2013.01); *B04B 5/0421* (2013.01); *B04B 2007/025* (2013.01)

(58) Field of Classification Search
CPC ..... B04B 7/06; B04B 5/0414; B04B 5/02; B04B 5/0421; B04B 2007/025
(Continued)

(56) References Cited

U.S. PATENT DOCUMENTS 2,699,289 A * 1/1955 Allen ..... B04B 5/0414 494/16
4,120,450 A * 10/1978 Whitehead ..... B04B 5/0421 494/20
5,211,808 A 5/1993 Vilardi et al.

FOREIGN PATENT DOCUMENTS

CN 1311061 9/2001
CN 202356200 8/2012
(Continued)

OTHER PUBLICATIONS

"Search Report of Europe Counterpart Application", dated May 28, 2019, p. 1-p. 8.
(Continued)

*Primary Examiner* — Walter D. Griffin
*Assistant Examiner* — Shuyi S. Liu
(74) *Attorney, Agent, or Firm* — JCIPRNET

(57) ABSTRACT

Provided is a centrifuge. In a centrifuge having a rotor with a rotor body that holds a sample and that is rapidly rotated, an inclined surface that extends upward as it extends radially outward is formed on an upper-side outer peripheral portion of the rotor, in a region that is at a radially outward side and at an upper side of the outer edge of an opening. The inclined surface is a continuous ring-like inclined surface that has the same cross-sectional shape in the circumferential direction and is formed into a straight-line shape or a curved-line shape in cross-section along a rotation central axis. Although winds occur during high-speed rotation of the rotor, the winds are rectified by the inclined surface, and a component
(Continued)

force for pressing the rotor body in a downward direction acts thereon.

10 Claims, 8 Drawing Sheets

(51) Int. Cl.
*B04B 5/02* (2006.01)
*B04B 7/02* (2006.01)

(58) Field of Classification Search
USPC ..... 494/16, 20
See application file for complete search history.

(56) References Cited

FOREIGN PATENT DOCUMENTS

| | | |
|---|---|---|
| CN | 203002477 | 6/2013 |
| JP | S50056270 | 5/1975 |
| JP | S57082956 | 5/1982 |
| JP | H1190273 | 4/1999 |
| JP | 3491495 | 1/2004 |
| JP | 3951615 | 8/2007 |
| JP | 2014237088 | 12/2014 |

OTHER PUBLICATIONS

"International Search Report (Form PCT/ISA/210) of PCT/JP2016/084950," dated Feb. 28, 2017, with English translation thereof, pp. 1-4.

"Office Action of China Counterpart Application", dated Jul. 3, 2019, with English translation thereof, p. 1-p. 13.

* cited by examiner

CENTRIFUGE AND CENTRIFUGE ROTOR FOR SUPPRESSING BUOYANCY

CROSS-REFERENCE TO RELATED APPLICATION

This application is a 371 application of the International PCT application serial no. PCT/JP2016/084950, filed on Nov. 25, 2016, which claims the priority of Japan patent application serial no. 2015-232496, filed on Nov. 28, 2015. The entirety of each of the above-mentioned patent applications is hereby incorporated by reference herein and made a part of this specification.

BACKGROUND

Technical Field

The present invention relates to a centrifuge (centrifugal separator) for separating samples in the fields of medicine, pharmaceutical science, genetic engineering, biotechnology, and the like.

Description of Related Art

A centrifugal separator includes a rotor capable of accommodating a plurality of sample containers filled with a sample, and a driving unit for rotationally driving the rotor in a rotor chamber, and centrifugally separates the samples in the sample containers by rotating the rotor in the rotor chamber and applying a centrifugal force. Rotors for centrifugal separators can be broadly classified into angle rotors and swing rotors. In the case of an angle rotor, a plurality of sample containers filled with a sample are accommodated in an accommodation hole, the accommodation hole is formed to have a certain angle with respect to a drive shaft, and regardless of a magnitude of a centrifugal force, the relative angle between the accommodation hole and the drive shaft is always fixed. A rotor cover (lid) is often mounted on an opening of an upper portion of the rotor to reduce windage loss and to prevent scattering of the sample and container fragments when the sample containers are broken or deformed. When the rotor cover is mounted, irregularities such as the accommodation hole of the sample container will not be exposed, and thus an effect of not disturbing the flow of air in the rotor chamber is great.

On the other hand, in swing rotors, a sample container filled with a sample inside a bucket having a bottom portion or a sample stored in an inner bag is mounted. On a side surface of the bucket, a recessed portion to be engaged with a protrusion cylindrical surface (rotating shaft) of the swing rotor body is provided on the facing surface, and the recessed portion is engaged by sliding on the protrusion cylindrical surface. When the rotor is stationary, a center line of the bucket and the drive shaft are parallel ($\theta=0°$), but as a rotation speed increases, a centrifugal force acts on the bucket which is swingably installed, and the bucket rotates around the rotation shaft ($\theta>0°$) and becomes almost horizontal ($\theta=90°$) at a rotation speed generating a centrifugal force that makes the bucket horizontal. When the centrifugal separation operation is completed and the rotation speed decreases, the swinging angle $\theta$ gradually decreases and becomes $\theta=0°$ when stopped. In this manner, in the swing rotor, a relative angle between the center line of the bucket and the drive shaft varies depending on the magnitude of the centrifugal force during rotation. The swing rotor has two types including a case in which a combination of the rotor body and the bucket is rotated in an exposed state in the rotor chamber, and a structure in which the whole of the rotor body and the bucket are covered with the shell and the rotor cover and set on the drive shaft and rotated.

When the swing rotor is centrifugally operated in the atmosphere, in a case in which the rotor has a large radius of rotation or a rotation speed is high, if the rotor is rotated in an exposed state, pressure resistance and frictional resistance increase and a phenomenon in which the rotor body and bucket generate heat occurs or a phenomenon in which it does not rise from a certain rotational speed occurs. Therefore, in the case of a large swing rotor or a swing rotor rotating at a high speed, a shell and a rotor cover (lid) are often used.

In both the angle rotor and the swing rotor, when attachment of the rotor cover is a major premise in the configuration, it is important to attach the rotor cover and perform centrifugal separation operation. When it is rotated in a state in which attachment of the rotor cover is forgotten, since inner side irregularities of an upper surface of the rotor are exposed, a turbulent flow is generated in the irregular portions and the speed change becomes abrupt, and consequently, a pressure difference with a planar lower portion of the outer circumferential surface of the rotor occurs, buoyancy occurs during rotation, and an unstable behavior is exhibited, and thus a burden on a drive portion support member (damper or the like) is likely to increase. In Patent Literature 1, as a method for preventing occurrence of buoyancy when attachment of the rotor cover is forgotten, a plurality of through holes are provided in a bottom portion of the swing rotor and a gap is intentionally provided between the shell and the rotor cover so that air flows back and forth and in and out of the shell. However, although this technology is effective for the swing rotor, it cannot be applied to angle rotors. In Patent Literature 2, a pressure of an upper portion inside the rotor chamber, or a pressure or pressure difference between the upper portion and a lower portion inside the rotor chamber is measured, and when the value exceeds a predetermined value, it is determined that the rotor cover is not mounted and then the rotor is stopped by stopping or decelerating the device.

CITATION LIST

Patent Literature

[Patent Literature 1]
Japanese Patent No. 3951615
[Patent Literature 2]
Japanese Patent No. 3491495

SUMMARY

Technical Problem

Regardless of the angle rotor and the swing rotor, in a product that is supposed to be attached with a rotor cover, since attachment of the rotor cover can be forgotten, when the rotor is rotated without the rotor cover, buoyancy may occur in the rotor during rotation, which may cause unstable behavior, and satisfactory centrifugal separation may not be possible. When the centrifugal separation operation is continued in such an unstable state, this will lead to an increase in a burden on the rotor and the centrifuge, which is a factor that shortens a service life of the centrifuge. Further, even in a product that does not require a rotor cover, a centrifuge in which the buoyancy of the rotor is suppressed and the behavior is more stable is desired.

The present invention has been made in view of this background, and an object thereof is to provide a centrifuge in which behavior of a rotor is stable and a centrifuge capable of inhibiting buoyancy generated during rotation and alleviating a burden on a drive portion support member (damper or the like) and the rotor even when it is assumed that the centrifugal operation is started in a state in which attachment of the rotor cover is forgotten.

Solution to Problem

Representative features of the invention disclosed in the present application will be described below. According to one feature of the present invention, there is provided a centrifuge including a motor, a rotor including a rotor body rotated by the motor and configured to hold a sample and a rotor cover that covering an opening portion of the rotor body, and a rotor chamber accommodating the rotor, in which an inclined surface extending toward a radial outer side of an outer edge of an upper surface of the rotor cover and upward is formed on the rotor.

The inclined surface is a continuous annular inclined surface curved from a lower side of a rotation shaft toward an upper side thereof from a radial inner side toward the radial outer side, and is a linear inclination or an inclination by an nth order curve in a cross-sectional shape passing through an axial direction of the motor. In addition, two or more holding portions of sample containers disposed obliquely at an angle with respect to a rotation axis are formed on the rotor body and the inclined surface is formed on an outer circumferential side of an opening of the sample holding portions of the rotor body.

According to another feature of the present invention, the rotor cover which covers the opening portion of the rotor body includes a through hole provided at a center thereof, and a knob portion is rotatably held at an end portion having a protrusion shape passing through the through hole, and the rotor cover is fastened to a screw portion of the rotor body with a screw portion formed on a lower end of the protrusion shape. In addition, an outer edge of an upper surface of the rotor cover has a planar portion, and the inclined surface is configured to be continuous with the planar portion. Further, the rotor cover includes an extended portion extending toward an outer side of an outer edge of the opening portion of the rotor body, and the inclined surface is formed on the extended portion.

According to still another feature of the present invention, there is provided a centrifuge including a motor, a swing rotor body rotated by the motor and configured to rotate a sample while swinging the sample, and a rotor chamber accommodating the swing rotor body and a shell having an opening portion at an upper side thereof, in which an inclined surface is configured to extend toward a radial outer side of an outer edge of the opening portion of the shell and upward. The inclined surface may be formed on an outer portion of the opening portion of the shell or at an extended portion of an shell cover of the shell at the outer side of the opening portion.

Advantageous Effects of Invention

According to the present invention, it is possible to inhibit buoyancy generated during rotation and alleviate a burden on a drive portion support member (damper or the like) and the rotor. In addition, even when the rotor cover is mounted, since a biasing force acts on the lower side in the axial direction against the rotor, unstable behaviors can be inhibited and a stable centrifugal separation operation can be performed.

The above and other objects and novel features of the present invention will become apparent from the following description of the specification and the drawings.

DESCRIPTION OF THE EMBODIMENTS

Example 1

Hereinafter, embodiments of the present invention will be described on the basis of the accompanying drawings. In the following drawings, the same portions will be denoted with the same reference signs, and repeated description thereof will be omitted. Further, in the present specification, when a vertical direction is described it refers to the direction illustrated in each of the drawings.

Figure 1:
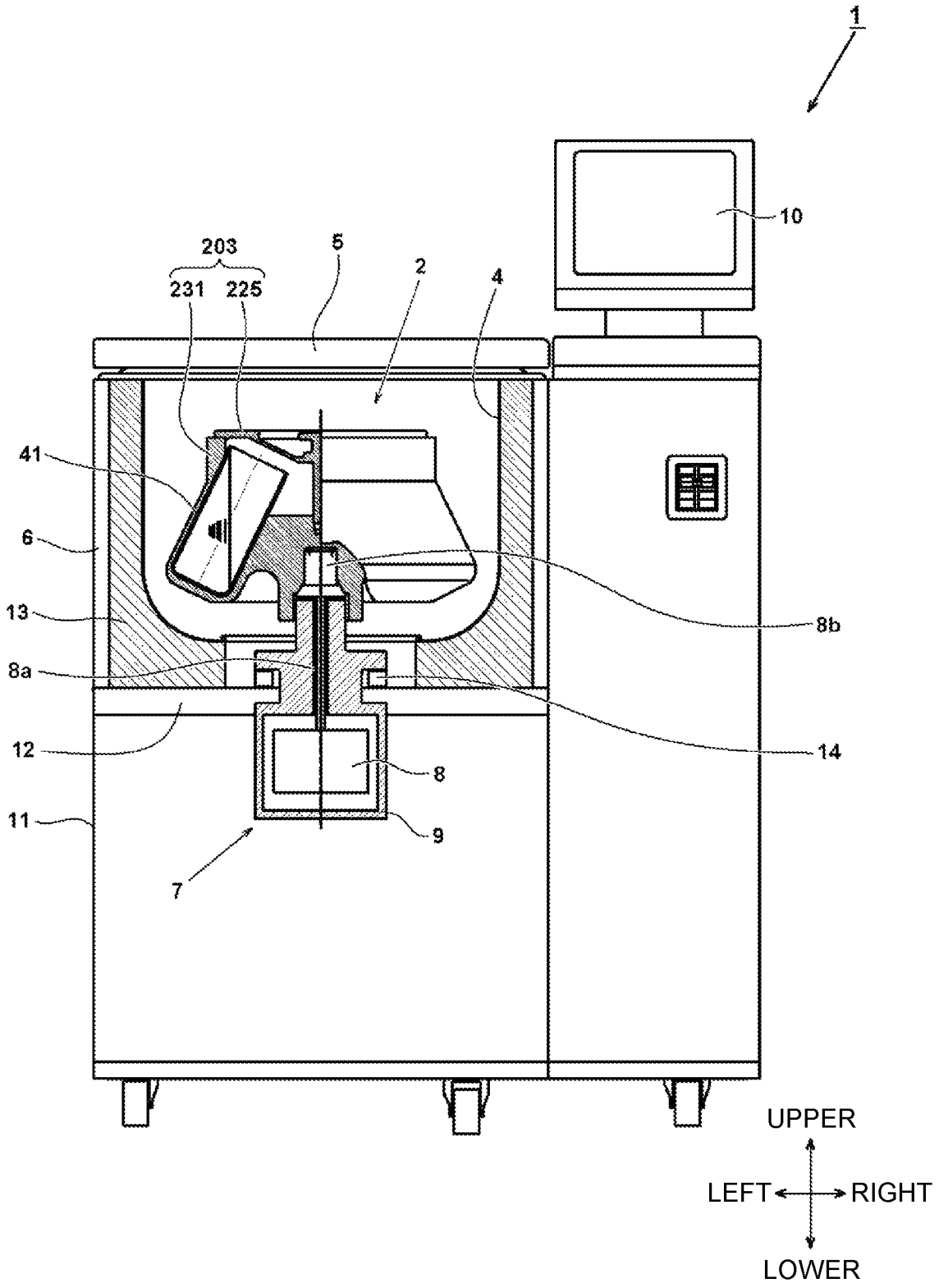
FIG. 1 is a front view (a partial longitudinal sectional view) illustrating an overall configuration of a centrifuge.

FIG. 1 is a cross-sectional view illustrating an overall structure of a centrifuge (however, a rotor 203 of a conventional example is mounted). The centrifuge 1 is accommodated in a box-shaped housing 11 mainly made of sheet metal, and the inside of the housing 11 is partitioned into a plurality of sections by a horizontal frame 12, a vertical partition plate (not illustrated), or the like. Here, a left space is partitioned by the frame 12 into two spaces of upper and lower stages, and a control device (not illustrated) for performing control of the entire centrifuge 1 and a cooling device (not illustrated) for cooling the rotor 203 are accommodated in a right space (not illustrated). On the right upper portion of the housing 11 and beside (to the right of) the door 5, an operation display unit 10 by which a user inputs conditions of a rotation speed of the rotor or a centrifugal separation time and on which various types of information are displayed is disposed. Inside a space on the left upper stage, a bowl 4 in which the rotor 203 is accommodated is provided. The bowl 4 is formed in a bottomed cylindrical shape having an opening on an upper surface and having a through hole in a center of the bottom, and is manufactured by integrally molding a metal that is not easily corroded such as stainless steel, an aluminum alloy, copper, or the like. The upper opening of the bowl 4 is closed by the door 5, and thereby a rotor chamber 2 is demarcated. A cylindrical protective wall 6 is provided on an outer circumferential side of the bowl 4 and inside the housing 11, and an insulating material 13 is filled between the protective wall 6 and the bowl 4. The door 5 is fixed in a single swinging manner by a hinge (not illustrated), and the rotor chamber 2 is sealed by a door packing (not illustrated).

A cooling pipe (not illustrated) is wound in close contact with an outer circumference of the bowl 4, and is connected to the cooling device (not illustrated). During an operation of centrifugal separation, the inside of the rotor chamber 2 is maintained at a set temperature by the cooling pipe. In the rotor chamber 2, the rotor 203 that can accommodate a sample container 41 in which a sample 42 is placed is accommodated. The rotor 203 is mounted on a crown 8*b* at a distal end of the drive shaft 8*a* and is rotatable around the drive shaft 8*a* so that the sample container 41 is rotated at a high speed. Various types and sizes of the rotor 203 can be used in accordance with a sample container, and can be mounted or detached with the door 5 opened. The rotor 203 is an angle rotor, and is constituted by a rotor body 231 and a rotor cover 225 mounted on an upper opening face of the rotor body 231.

A drive unit 7 is attached to the frame 12 in a lower stage partitioned by the frame 12 in the housing 11. The drive unit 7 is configured to include a motor 8 and a motor housing 9 which houses the motor 8 and is fixed to the frame 12 via a damper 14.

The drive shaft 8*a* extending vertically upward from the motor 8 penetrates the bowl 4 and reaches the inside of the rotor chamber 2, and a crown 8*b* to which an mounting hole 32 of the rotor 203 is mounted is provided at an upper end portion thereof.

Figure 2:
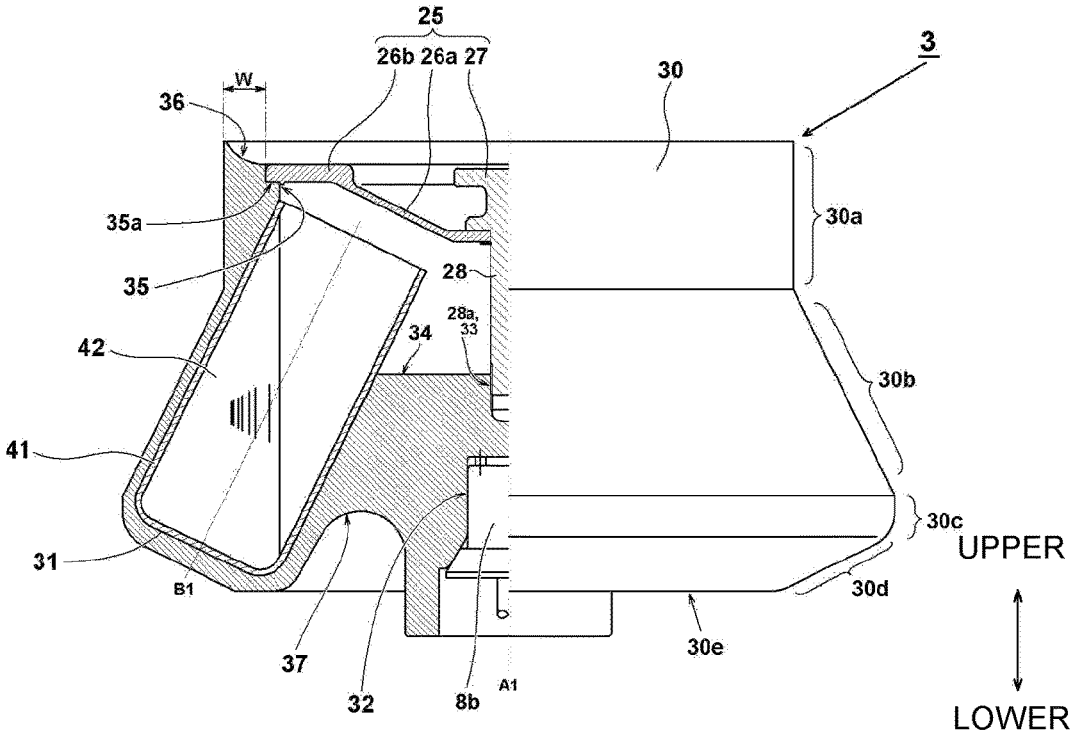
FIG. 2 is a view illustrating a rotor 3 according to an example of the present invention, in which the left half is a longitudinal sectional view and the right half is a front view.

FIG. 2 is a view illustrating the rotor 3 according to an example of the present invention, in which the left half is a longitudinal sectional view and the right half is a front view. The rotor 3 is mounted in place of the rotor 203 of the centrifuge 1 illustrated in FIG. 1, and configurations, sizes, or the like of the main portion are the same as those of the conventional rotor 203 illustrated in FIG. 1 except for a difference in presence or absence of the inclined surface 36 and a shape in the vicinity thereof. In the description of the present specification, when the term "rotor" is simply used, it indicates a state in which the rotor cover 25 and accessories are mounted on a rotor body 30 in the case of a type in which a rotor cover is mounted, and it indicates a state in which the rotor body 30 and accessories are mounted in a case in which a rotor cover is unnecessary. A plurality of container holding holes 31 serving as holding portions for holding the sample container 41 are formed on the rotor body 30. Each of the container holding holes 31 is disposed such that its center line B1 is oblique at a certain angle with respect to a rotation axis (central axis) A1 of the rotor 3, and an opening of the container holding hole 31 is disposed on an upper side thereof. Two or more container holding holes 31 are formed on the rotor body 30. A flat portion 34 is formed near the center in a vertical direction of the rotor body 30, and thus the inner circumferential side of an upper half of the rotor body 30 is hollow. When this part is made hollow, a user can easily mount and detach the sample container 41, and it is possible to reduce the weight of the rotor body 30. A screw hole 33 for fixing the rotor cover 25 is formed on a center of the flat portion 34.

The rotor body 30 has an outer shape corresponding to an arrangement of the container holding hole 31, and a cylindrical portion 30*a* for protecting an upper portion of the container holding hole 31 is formed on an upper side of an outer edge. An enlarged diameter portion 30*b* expanding toward a radial outer side from an upper side toward a lower side is connected to a lower side of the cylindrical portion 30*a*, a reduced diameter portion 30*d* in which the diameter reduces from an upper side toward a lower side is formed beneath an extreme diameter portion 30*c* which is interposed between the enlarged diameter portion 30*b* and the reduced diameter portion 30*d*, and a bottom portion 30*e* is formed beneath the reduced diameter portion 30*d*. In the bottom portion 30*e*, a reduced thickness portion 37 in which a metal portion is cut in a substantially cylindrical shape in an upper direction (on an opening side) of a rotation axis A1 to reduce a weight is formed. On an upper side of the rotor body 30, an opening 35 having a circular outer diameter and configured for the sample container 41 to be put in and taken out is formed. Here, an outer edge portion of the opening 35 is accompanied by a stepped portion 35*a* so that the rotor cover 25 can be easily mounted, and the rotor cover 25 is mounted on an upper side of the opening 35. The rotor cover 25 has substantially the same shape as a rotor cover 105 of the conventional rotor 203, and includes a planar annular horizontal portion 26*b* for protecting the vicinity of the upper outer periphery of the container holding hole 31 and a recessed portion 26*a* having a shape along the upper side of the rotor body 30 that is inclined obliquely downward at an inner circumferential side of the annular horizontal portion 26*b*. A through hole is provided at a center of the rotor cover 25, a handle 27 having a protrusion shape is rotatably fastened to the through hole, and the rotor cover 25 is fastened to the screw hole 33 of the rotor body 30 with a screw portion 28*a* provided at a distal end (lower end) of a shaft 28 rotating in conjunction with the handle 27. Although detailed illustration is omitted here, the handle 27 and the shaft 28 are configured as an integral body, but they may be configured as separate bodies.

In a radial outer region with respect to an outer edge of an upper surface of the rotor cover 25 of the rotor body 30, the inclined surface 36 is formed such that a height increases gradually from a radial inner side toward an outer side. Here, the inclined surface 36 is formed to have a width W in a radial direction of the outer edge portion, and the innermost circumferential edge is formed on the same height to be continuous with an upper surface of the annular horizontal portion 26*b* of the rotor cover 25. Thus, the height gradually increases toward a radial outer side. The inclined surface 36 has the same shape in the circumferential direction, that is, the inclined surface 36 has a shape of a continuous annular wall in which a longitudinal cross section passing through the rotation axis A1 taken at any position is the same.

Figure 3:
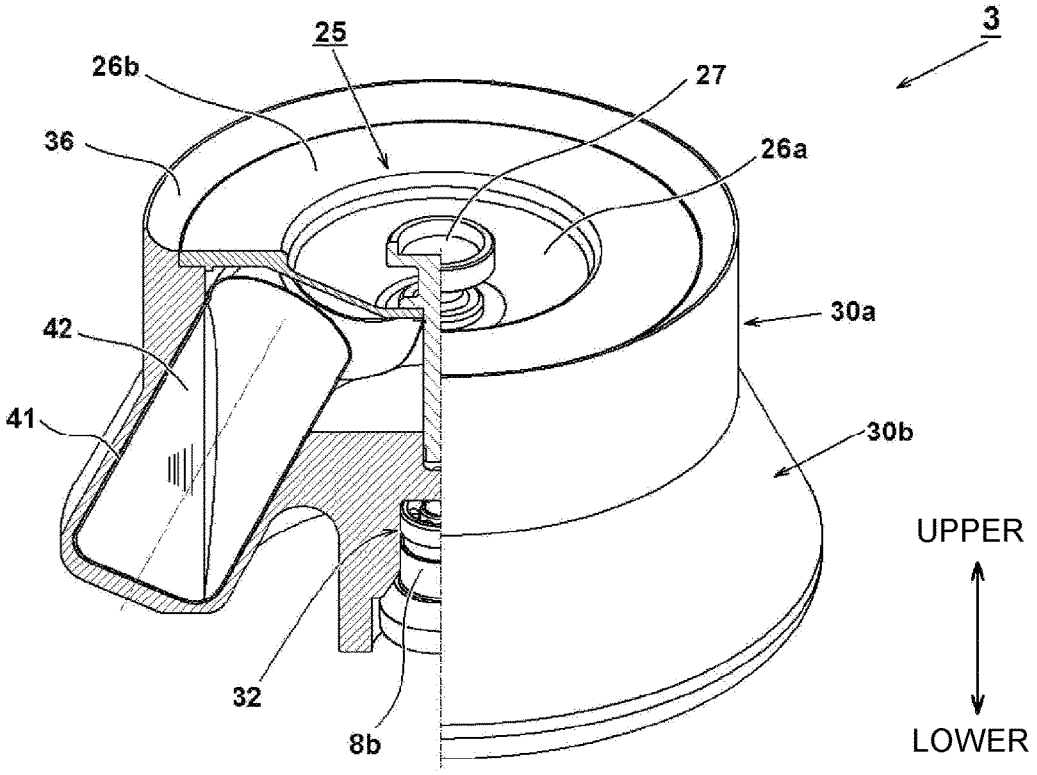
FIG. 3 is a perspective view of the rotor 3 according to an example of the present invention, and illustrates a partial cross-sectional view.

FIG. 3 is a perspective view of a rotor according to an example of the present invention, and illustrates partial cross-sectional view. As can be understood from this figure, an upper surface portion of the rotor 3 is formed to be rotationally symmetrical so that the upper surface of the rotor cover 25 and the inclined surface 36 of the rotor body 30 have the same shape in the circumferential direction. The recessed portion 26*a* is formed around the handle 27 of the rotor cover 25, but the annular horizontal portion 26*b* having a flat upper surface is formed on a portion corresponding to about ⅓ of the radial outer side to have a configuration in which airflow flowing from the radial inner portion to the outer portion flows smoothly without disturbance. Further, on an outer circumferential side of the annular horizontal portion 26*b*, the inclined surface 36 that is inclined upward is formed toward the outer side. Air obliquely flowing from a rotation center direction of the rotor cover 25 toward the radial outer side is guided upward by the inclined surface 36 so that the flow of the air is rectified, and the inclined surface 36 is directed to obtain an effect of generating a force to push the rotor 3 downward in a direction of the rotation axis A1, that is, a so-called air spoiler effect, by a component force of the force of airflow hitting the inclined surface 36. The inclined surface 36 is a surface continuous with the upper surface of the annular horizontal portion 26*b* and may be configured not to form a turbulent flow at a boundary portion therebetween when air flows from the upper surface of the annular horizontal portion 26*b* to the inclined surface 36 side. When the inclination of the radial outer side of the inclined surface 36 is appropriately set as described above, a flow of air inside the rotor chamber 2 can be rectified.

Figure 4:
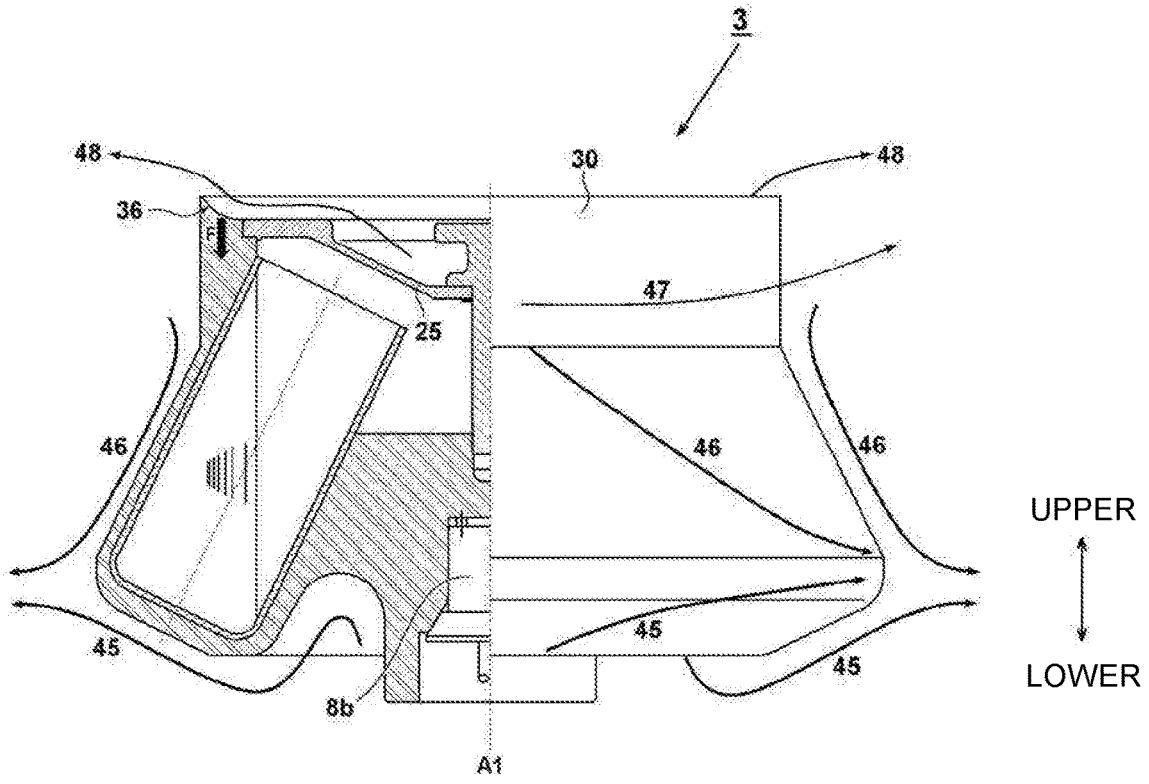
FIG. 4 is a view illustrating airflow in a state in which a rotor cover of the rotor 3 according to an example of the present invention is attached.
Figure 11:
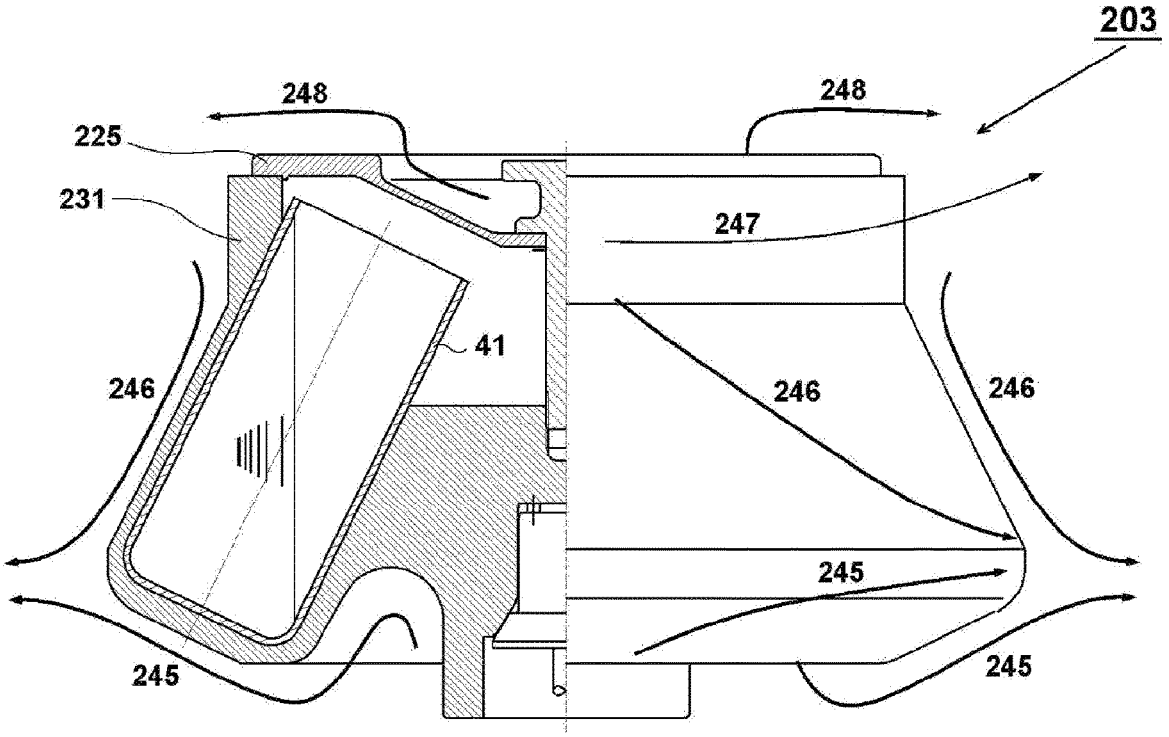
FIG. 11 (RELATED ART)
FIG. 11 is a view illustrating a conventional rotor 203 and airflow generated by its rotation, in which the left half is a longitudinal sectional view and the right half is a front view.
Figure 12:
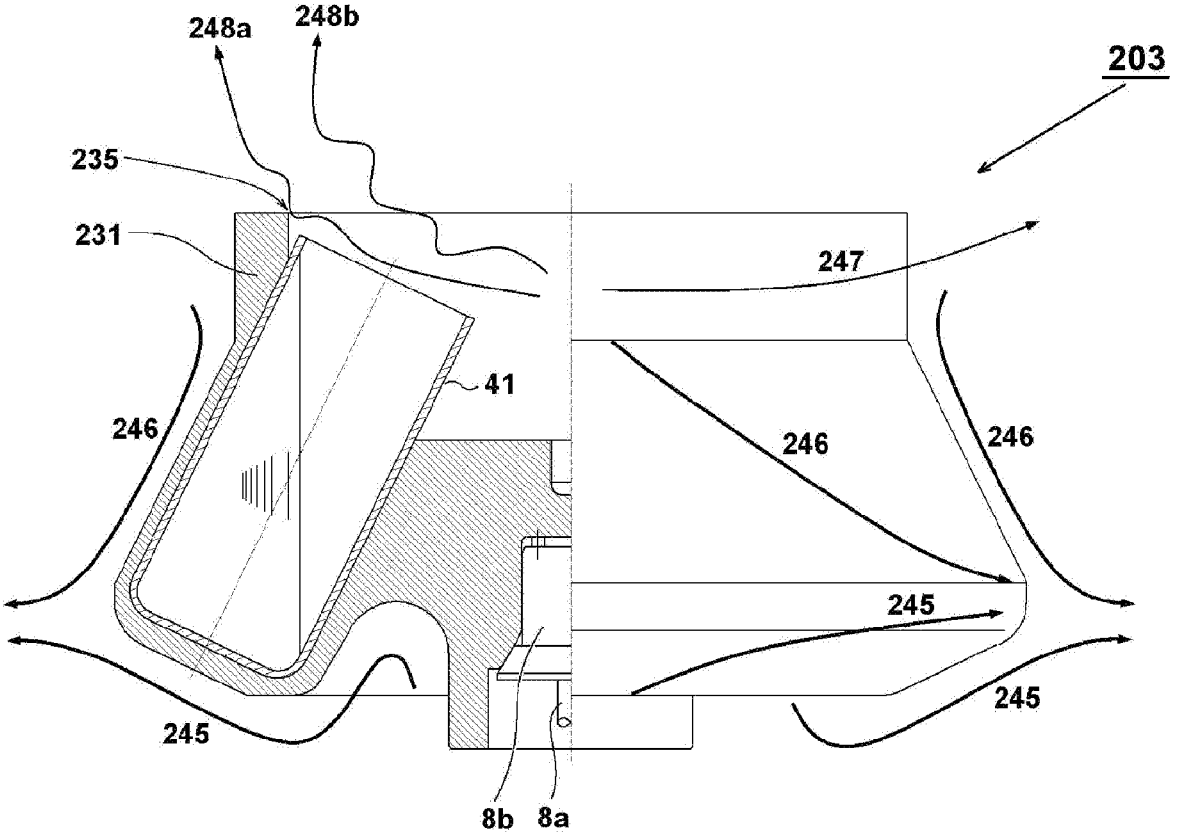
FIG. 12 (RELATED ART)
FIG. 12 is a view illustrating airflow when the conventional rotor 203 rotates in a state in which a rotor cover 105 is removed.

FIG. 4 is a view illustrating airflow when the rotor 3 rotates in a state in which the rotor cover 25 is attached to the rotor body 30. Before describing the present example, airflow in a rotor chamber of the rotor 203 of a conventional example will be described with reference to FIG. 11. FIG. 11 is a view illustrating the conventional rotor and airflow generated by rotation, in which the left half is a longitudinal sectional view and the right half is a front view. The airflow generated in the rotor chamber by the rotation of the rotor 203 reaches the radial outer side while it flows obliquely from the center side to the outer side according to a rotation direction of the rotor 203, hits an inner wall portion of the bowl to flow upward or downward along the side wall, and flows through the vicinity of the upper wall or the vicinity of the bottom surface of the rotor chamber while it flows toward a radial inner side. In the rotor 203 of the conventional example, the airflow 246 to 248 flows through the upper side of the rotor chamber and the airflow 245 flows through the lower side of the rotor chamber. FIG. 12 is a view illustrating airflow when the conventional rotor rotates in a state in which the rotor cover 105 is removed. Here, since the rotor cover 105 is not mounted on the opening 235 and an inner portion of the rotor 203 is exposed, the airflow 248 illustrated in FIG. 11 flows as a turbulent flow such as the airflow 248*a* or 248*b*.

The description returns to FIG. 4. In the present example, the flow of wind 45 to wind 47 flows in substantially the same way as the flow of wind 245 to wind 247 in the rotor 203 of the conventional example illustrated in FIG. 11. However, in the upper portion of the rotor 3, particularly in the upper surface portion of the rotor cover 25, the flow 48 in FIG. 4, with respect to the flow 248 in FIG. 11, has an increased upward component as illustrated. That is, an air flow rate toward the radial outer side in the flow 248 of FIG. 11 decreases in the flow 48 due to an action of the inclined surface 36 and upward air flow increases as shown by the flow 48. Therefore, since a component force F that pushes the rotor 3 downward by the air colliding with the inclined surface 36 acts, the rotor 3 can press the crown 8*b* and the rotor 3 can be stably rotated.

Figure 5:
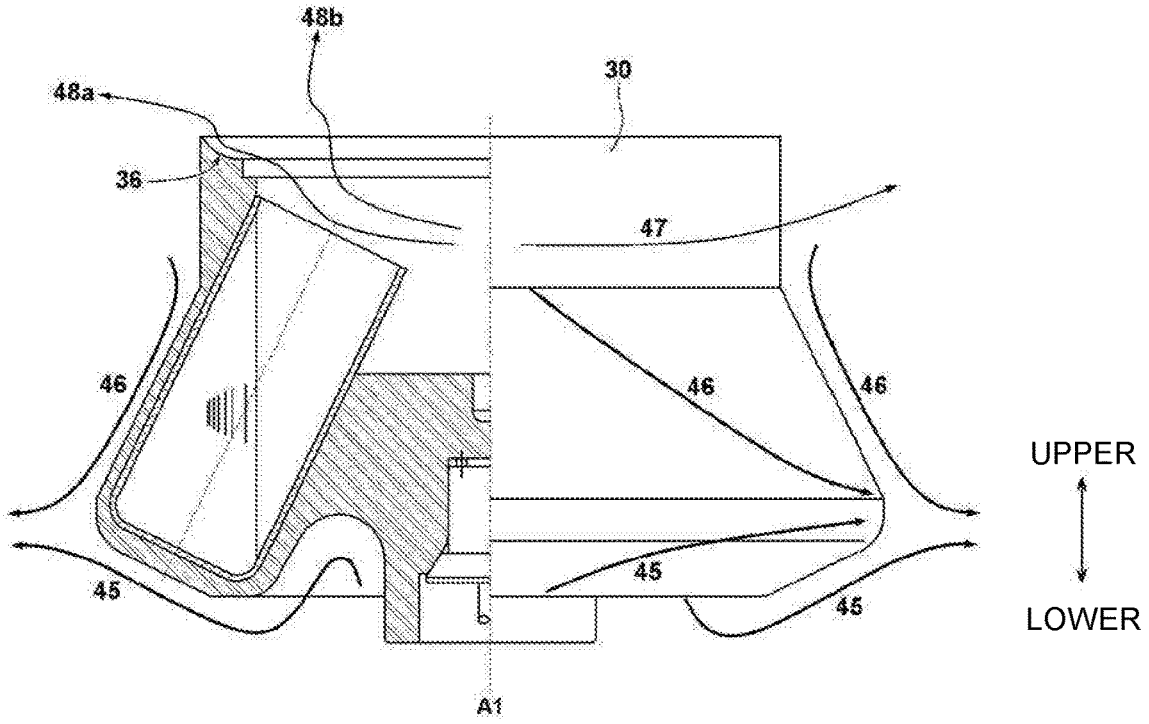
FIG. 5 is a view illustrating airflow in a state in which attachment of the rotor cover of the rotor 3 according to the example of the present invention is forgotten.

FIG. 5 is a view illustrating airflow when the rotor 3 rotates in a state in which attachment of the rotor cover 25 to the rotor body 30 is forgotten. As in the flow of wind 248*a* and wind 248*b* of the conventional example illustrated in FIG. 12, since the rotor cover 25 is not included, an irregular portion in the rotor body 30 is exposed and airflow shown as wind 48*a* and 48*b* becomes turbulent. However, in the present example, since the inclined surface 36 is provided in the vicinity of the outer edge of the upper surface of the rotor 3, a portion (airflow 48*a*) of turbulent airflow hits the inclined surface 36, and thereby the flow is rectified upward as indicated by wind 48*a*. Thereby, since a downward component force in the direction of the rotation axis A1 acts on the rotor body 30, it is possible to inhibit a decrease in pressure on the upper surface side of the rotor body 30 as compared with the rotor 203 of the conventional example and a pressure difference with the bottom surface side of the rotor body 30 can be reduced. Accordingly, it is possible to alleviate a burden on a drive portion support member (damper or the like) and the rotor during a period until a worker realizes that attachment of the rotor cover 25 has been forgotten and performs the centrifugal separation operation again. A gradient of the inclined surface 36 is preferably larger, and furthermore, as a surface area of the gradient portion grows larger, the downward component force in the direction of the rotation axis A1 becomes larger. However, when the inclination is too large, a circumferential velocity of an outermost wall portion increases, and pressure resistance and frictional resistance increase, and thus the inclination may be appropriately determined in consideration of a shape, mass, or the like of the rotor 3.

Figure 6:
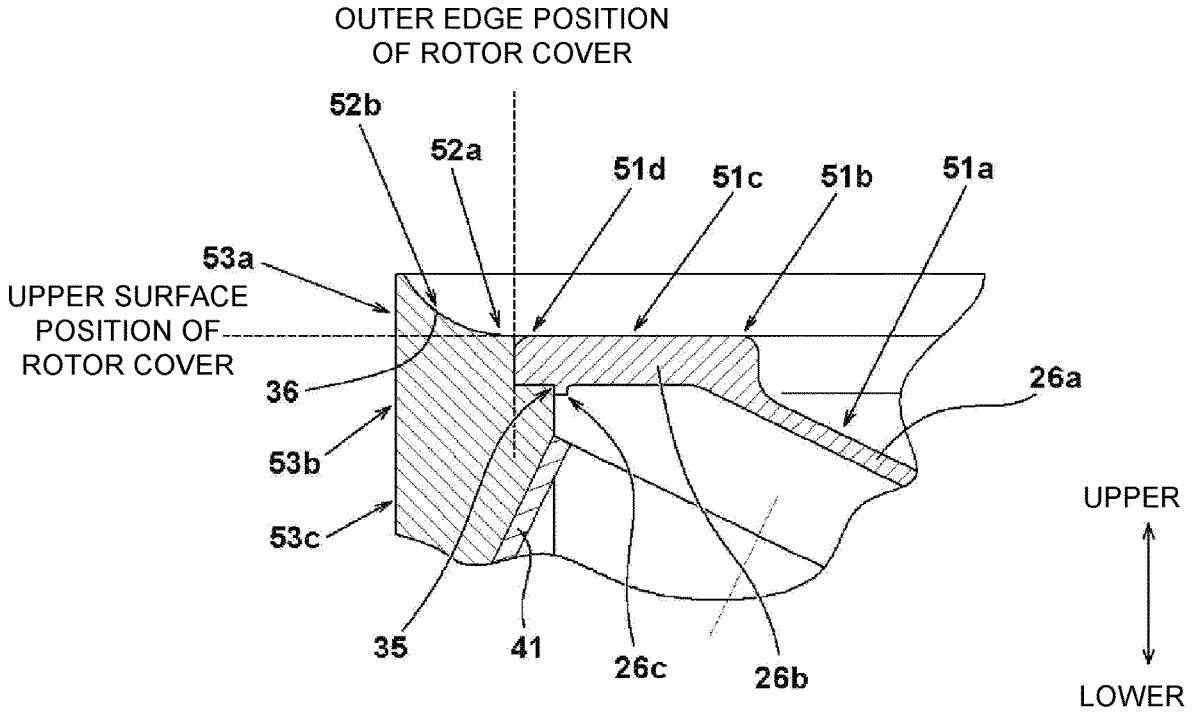
FIG. 6 is a longitudinal sectional view for describing a cross-sectional shape of an inclined surface of the rotor 3 of FIG. 2.

FIG. 6 is a longitudinal sectional view for describing a cross-sectional shape of the inclined surface of the rotor 3 of FIG. 2. In the rotor cover 25, an outer circumferential side of the recessed portion 26*a*, which is an inner circumferential side of an arrow 51*a*, is an annular horizontal portion 26*b* whose upper surface is horizontal. The annular horizontal portion 26*b* is a surface that is substantially horizontal and continuous in a circumferential direction in a region of the arrows 51*b* to 51*d*. The inclined surface 36 formed on the outer circumferential side of the annular horizontal portion 26*b* is formed to be the same surface as the vicinity of the outer edge (arrow 51*d*) of the annular horizontal portion 26*b* on the inner circumferential side in the vicinity of the arrow 52*a*, and is inclined upward therefrom toward the radial outer side as shown by an arrow 52*b*. Further, a corner portion of an outer edge of the annular horizontal portion 26*b* indicated by the arrow 51*d* is slightly rounded (chamfered), and there is a slight gap between an outer edge position of the rotor cover and a vertical wall of a stepped portion 35*a* of the rotor body 30. However, these gaps need only be big enough for the rotor cover 25 to be smoothly opened and closed, and are not big enough to disturb the air flowing on the upper surface of the rotor cover 25. A cylindrical stepped portion 26*c* is formed on a portion of a lower surface of the rotor cover 25 with which the opening 35 comes into contact. On the other hand, a shape of the outer circumferential surface of the inclined surface 36 is a cylindrical surface having the same outer diameter as the arrows 53*a* to 53*c*.

Figure 7:
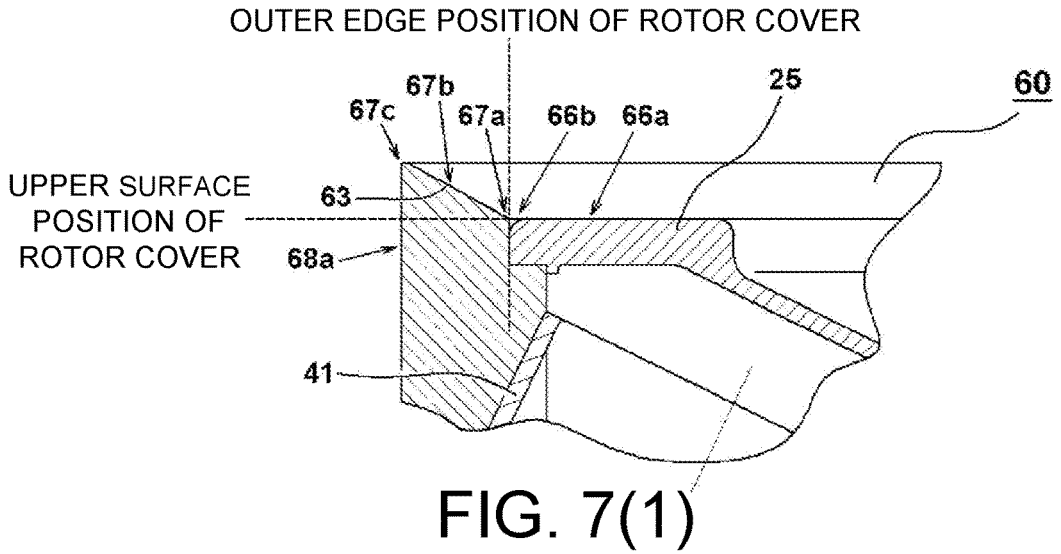
FIGS. 7(1)~7(3) are longitudinal sectional views for describing a cross-sectional shape of an inclined surface of a rotor according to a modified examples of the example.
Figure 7:
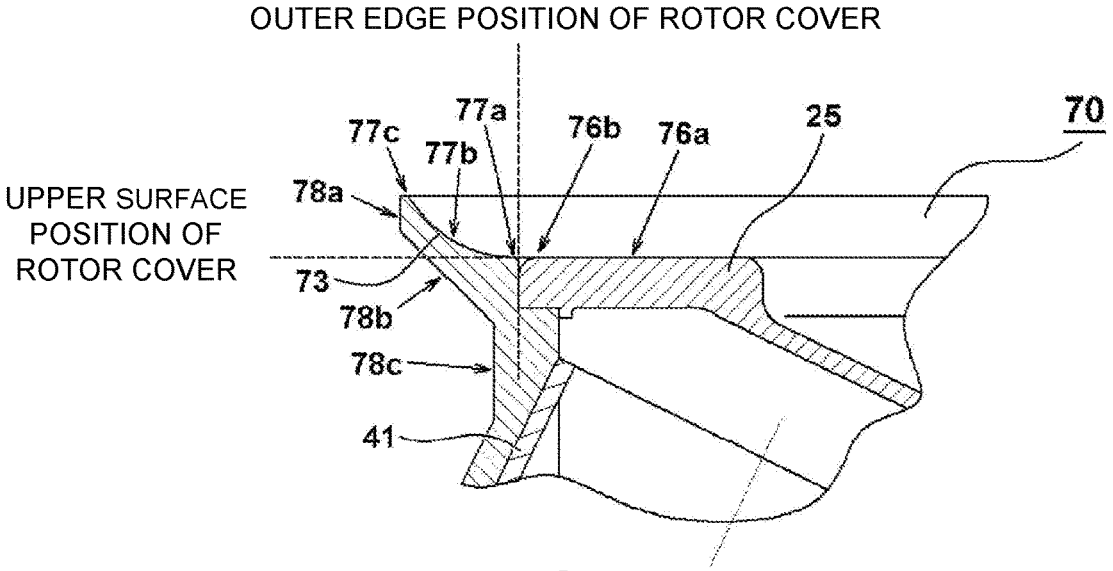
Figure 7:
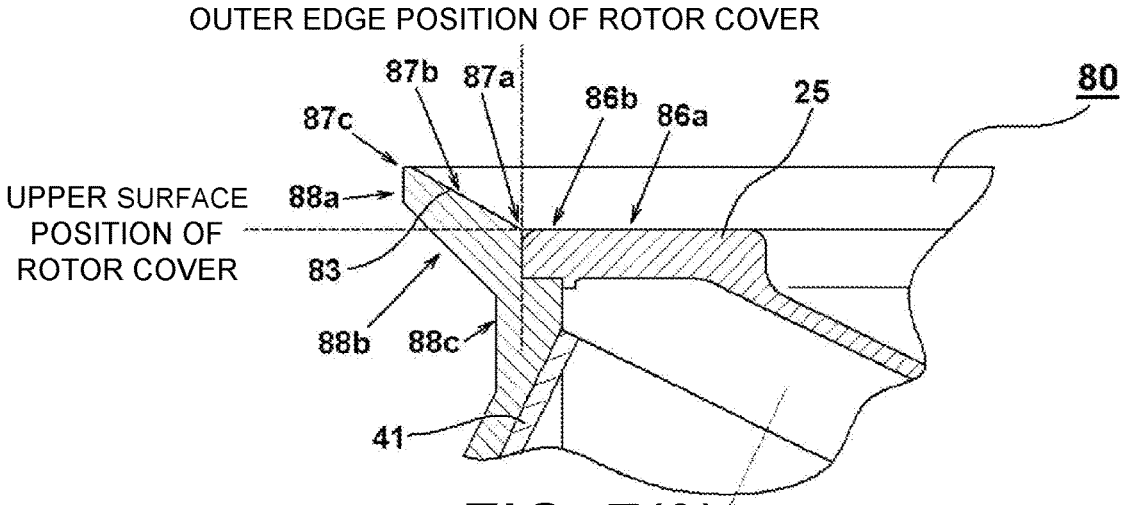

Next, modified examples of Example 1 will be described with reference to FIGS. 7(1) to 7(3). FIGS. 7(1) to 7(3) are partial cross-sectional views (views corresponding to FIG. 6) in the vicinity of inclined surfaces of rotors illustrating Modified Examples 1 to 3. In FIGS. 7(1) to 7(3), shapes of the rotor cover 25, the container holding hole 31, and the sample container 41 are the same as those of Example 1 illustrated in FIGS. 2 to 6, and shapes of the inclined surfaces (63, 73, 83) are different from each other. Further, a shape in the vicinity of the upper end on an outer circumferential side of rotor bodies (60, 70, 80) is changed according to a shape of the inclined surface.

FIG. 7(1) illustrates the vicinity of an outer circumferential edge of an upper end of the rotor body 60 of Modified Example 1, in which an inclined surface 63 having a linear cross-sectional shape is formed on an outer circumferential side of a rotor cover outer edge position of the rotor cover 25 and an upper portion of an upper surface position of the rotor cover. Here, in the rotor cover 25, a portion indicated by arrows 66*a* and 66*b*, and ranging from an innermost circumferential position (arrow 67*a*) to the vicinity of a center in a radial direction (arrow 67*b*) and an outermost circumferential position (arrow 67*c*) in the inclined surface 63 is formed as a substantially continuous surface. Further, the inclined surface 63 is a linear inclined surface in a cross-sectional view continuous in the circumferential direction. An outer circumferential surface of the rotor body 60 is a cylindrical surface 68*a* extending in a vertical direction.

FIG. 7(2) illustrates the vicinity of an outer circumferential edge of an upper end of the rotor body 70 of Modified Example 2, in which an inclined surface 73 having a curved cross-sectional shape is formed on an outer circumferential side of a rotor cover outer edge position of the rotor cover 25 and an upper portion of an upper surface position of the rotor cover. The inclined surface 73 has the same or substantially the same cross-sectional shape as the inclined surface 36 of Example 1, and its cross-sectional curve can be defined by a quadratic function. In the rotor cover 25, a portion indicated by arrows 76*a* and 76*b* is a plane, and a portion ranging from an innermost circumferential position (arrow 77*a*) to the vicinity of a center in a radial direction (arrow 77*b*) and an outermost circumferential position (arrow 77*c*) in the inclined surface 73 is formed as a substantially continuous surface. Particularly, the inclination gradually increases in the portion indicated by the arrows 77*a* to 77*c*. An outer circumferential surface of the rotor body 70 is formed to include a cylindrical surface 78*a* extending slightly in a vertical direction from the top, an inclined wall 78*b* disposed thereunder and having a diameter that gradually narrows, and a cylindrical surface 78*c* disposed thereunder and having a diameter smaller than that of the cylindrical surface 78*a*. This shape is intended to reduce the weight of the rotor body 70 by scraping off a solid portion of the rotor body 70 as much as possible in a lower region of the inclined surface 73.

FIG. 7(3) illustrates the vicinity of an outer circumferential edge of an upper end of the rotor body 80 of Modified Example 3, in which an inclined surface 83 having a linear cross-sectional shape is formed on an outer circumferential side of a rotor cover outer edge position of the rotor cover 25 and an upper portion of an upper surface position of the rotor cover. Here, in the rotor cover 25, a portion indicated by arrows 86*a* and 86*b* is a plane, and a portion ranging from an innermost circumferential position (arrow 87*a*) to the vicinity of a center in a radial direction (arrow 87*b*) and an outermost circumferential position (arrow 87*c*) in the inclined surface 83 is formed as a substantially continuous surface. Further, a cross-sectional shape is a straight line from the innermost circumferential position (arrow 87*a*) to the outermost circumferential position (arrow 87*c*) of the inclined surface 83. An outer circumferential surface of the rotor body 80 is formed to include a cylindrical surface 88*a* extending slightly in a vertical direction, an inclined wall 88*b* disposed thereunder and having a diameter that gradually narrows, and a cylindrical surface 88*c* disposed thereunder and having a diameter smaller than that of the cylindrical surface 88*a*. This rotor body 80 is intended to reduce the weight by scraping off a solid portion of the cylindrical surface 68*a* on the outer circumferential side of the rotor body 60 in FIG. 7 (1).

As described above, although the three Modified Examples 1 to 3 of Example 1 are illustrated in FIGS. 7(1) to 7(3), in any of the examples, the inclined surface is formed to gradually become higher upward in the radial outer direction in the region on the upper side of the rotor cover outer edge position and on the upper side of the rotor cover upper surface position. When this inclined surface is provided, it is possible to generate a component force toward a lower side (motor side) in the direction of the rotation axis A1 with respect to the rotor, and thereby the rotor can be stably held by the crown 8*b*.

Example 2

Figure 8:
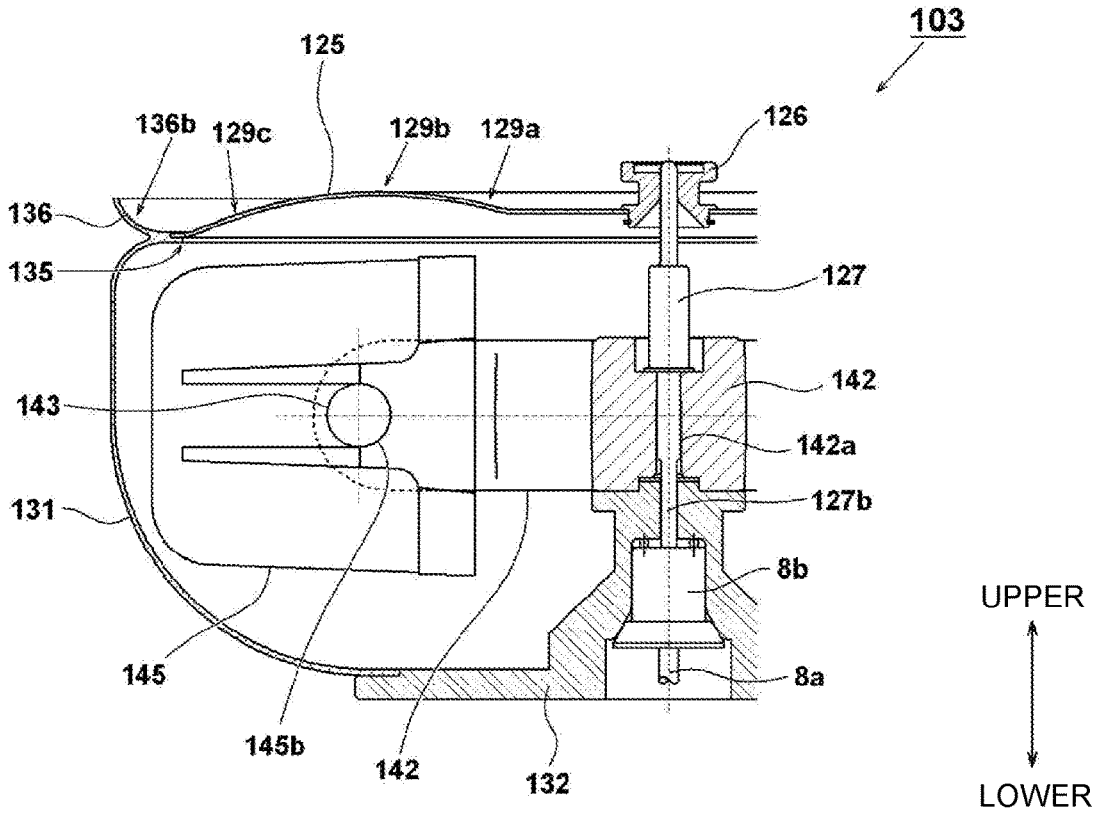
FIG. 8 is a partial cross-sectional view of a rotor 103 according to a second example of the present invention.

FIG. 8 is a partial cross-sectional view of a rotor 103 according to Example 2 of the present invention. Here, a state in which the rotor 103 is rotating at a high speed and a longitudinal direction of a bucket 145 is a horizontal direction is illustrated. In Example 2, the idea of the inclined surface 36 of Example 1 is applied to a swing type rotor (swing rotor) 103 which is a swing type with a shell 131 and a shell cover 125. The shell 131 annularly covers from a bottom portion to an upper portion having a gap configured not to come into contact with the bucket 145 even when the bucket 145 swings, an opening 135 having a large diameter so that the bucket 145 can be attached to a swing rotor body 142 is provided on an upper portion of the shell 131, and a shell cover 125 covering the opening 135 is provided. In Example 2, an annular inclined surface portion 136 continuous in a circumferential direction is formed on the vicinity of an outer circumferential edge of an upper end of the shell 131.

The rotor 103 is an assembly accommodating a swing rotor body 142 on which a plurality of buckets 145 are set in a container formed of the shell 131, a base 132, and the shell cover 125. For example, a plurality of buckets 145 set (here, four) are accommodated, and sample containers or bags (neither is illustrated) filled with a sample are accommodated in the buckets 145. A pair of protrusions (rotation shaft) 143 for holding the bucket 145 to be swingable is provided in the swing rotor body 142, and a recessed portion 145*b* engaged with a cylindrical surface of the protrusion 143 is provided on the side of the bucket 145. The bucket 145 has an inner wall shape that matches an outer shape of a sample container or bag (not illustrated) and is manufactured by integrally molding a light metal alloy. During rotation of the rotor 103 in a centrifugal separation operation, the shell 131 and the shell cover 125 are used to prevent a temperature rise due to frictional heat caused between air and irregularities of the rotor 103, and to reduce noise such as airflow noise, and thus it is important that the shell 131 and the shell cover 125 have good heat conductivity, excellent strength, and light weight. Here, they are made of a metal such as an aluminum alloy. The base 132 connects the swing rotor body 142 to the shell 131, and a bowl-shaped container portion is formed by the shell 131 and the base 132. A recess having a columnar shape is provided at a center of the base 132, and the recessed portion is mounted on the crown 8*b*.

A circular opening 135 larger than an outer diameter of the swing rotor body 142 is formed on an upper side of the shell 131. A substantially disk-like shell cover 125 is mounted the opening 135 of the shell 131. A shape of an upper side of the shell cover 125 gently protrudes upward at a portion indicated by arrows from 129*a* to 129*b* and 129*c*. This is to prevent contact with the bucket 145 when the bucket 145 swings in an internal space of the shell 131. A knob 126 is attached to a center of the shell cover 125, and an upper distal end portion of a lock screw 127 is inserted into the center of the knob 126. The swing rotor body 142 and the base 132 are fastened by a bolt (not shown) or the like. A lower screw portion 127*b* of the lock screw 127 passes through a through hole 142*a* at a center of the swing rotor body 142, and a fitting hole provided in the base 132 is screwed with a screw hole formed on the crown 8*b* of the centrifuge 1. In this way, the shell 131 and the swing rotor body 142 can be moved together, and the swing rotor body 142 can be fixed by screwing the screw portion of the lock screw 127 into the screw hole provided in the crown 8*b* of the centrifuge 1.

Figure 9:
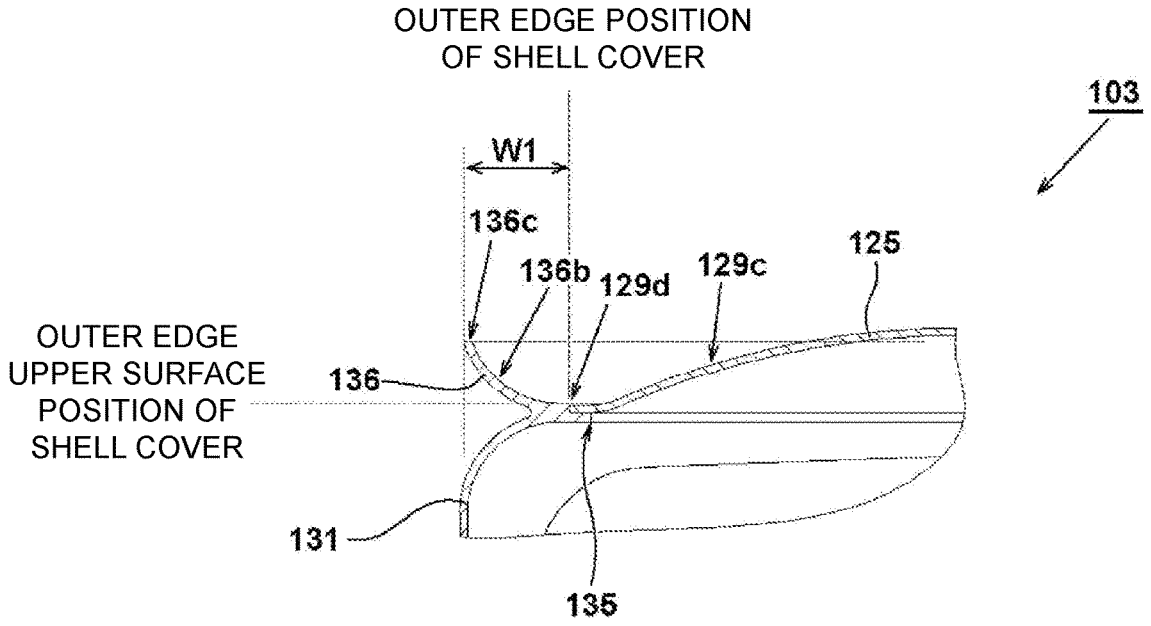
FIG. 9 is a longitudinal sectional view for describing a cross-sectional shape of an inclined surface of the rotor 103.

FIG. 9 is a partially enlarged cross-sectional view of the vicinity of the inclined surface portion 136 of FIG. 8. The annular inclined surface portion 136 which is curved obliquely from a lower side of the rotation shaft toward an upper side and a radial outer side is formed on an outer circumferential side of the shell cover 125 and on an outer circumferential side of an outer edge position of the shell cover 125. The inclined surface portion 136 is formed on an annular shape continuous in the circumferential direction and it is preferable that a width W1 in the radial direction of the inclined surface portion 136 be formed by a predetermined length, and here, the outer edge position (arrow 129*d*) of the shell cover 125 is positioned on an outer side of the opening 135. The inclined surface portion 136 is smoothly connected to be continuous with an upper surface of the arrow 129*d*, and is curved upward in a cross-sectional view to increase the inclination angle at a portion indicated by the arrows 136*b* to 136*c*. An outer edge position (arrow 136*c*) of the inclined surface portion is positioned on an upper side of an upper surface position (a height in the vicinity of the arrow 129*d*) of an outer edge portion of the shell cover 125. Here, the shell 131 and the inclined surface portion 136 are integrally manufactured by metal pressing, but the manufacturing method is not limited to this, and only the inclined surface portion 136 may be formed as a separate part and attached to the shell 131 by welding or adhesion. In the rotor 103 of FIGS. 8 and 9, a shell cover for a conventional swing rotor can be used as it is for the shell cover 125.

Figure 10:
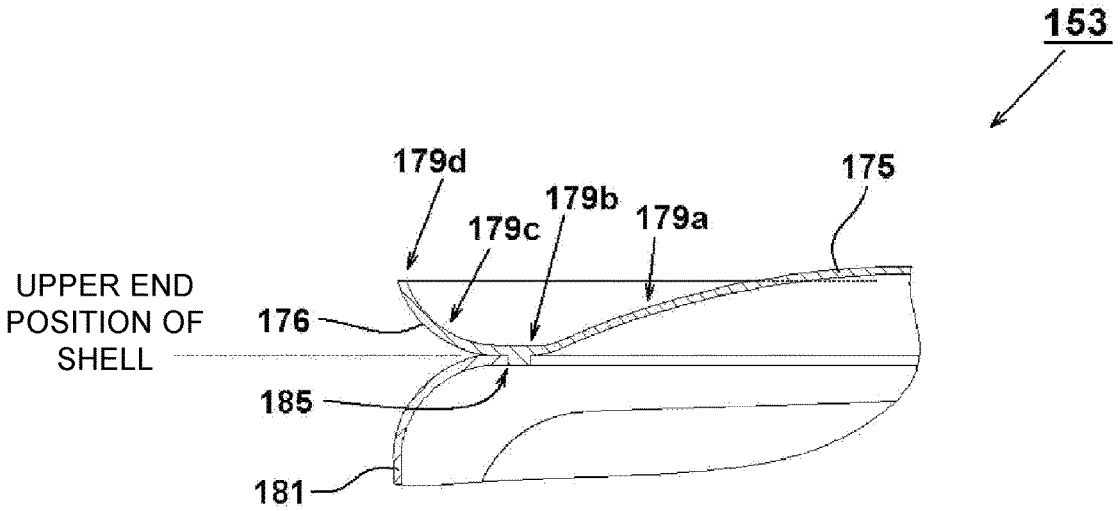
FIG. 10 is a partially enlarged cross-sectional view of the inclined surface of FIG. 8.

Next, a modified example of Example 2 will be described with reference to FIG. 10. In the rotor 103 of FIGS. 8 and 9, the inclined surface portion 136 is provided on the shell 131 side, whereas in an example of FIG. 10, an inclined surface portion 176 is formed on a shell cover 175 side. A shape of a shell 181 is the same as that of a conventional rotor in which an inclined surface is not provided, and a shape of the shell cover 175 is different from a conventional one. Therefore, this modified example can be easily realized by changing only the shell cover of the swing rotor in a conventional centrifuge. A shape of the shell cover 175 in the vicinity of a portion indicated by arrows 179*a* to 179*b* is the same as that of FIG. 8, but has an extended portion such as a portion indicated by arrows 179*c* and 179*d* extending outward from an outer edge of an opening 185 of the shell 181, and the extended portion is the inclined surface portion 176.

As described above, according to Example 2, in the upper and outer region of the opening (135, 185) of the shell, since an inclined surface portion in which a position is inclined upward toward the radial outer side is formed when the swing rotor is rotated with the shell cover (125, 175) mounted, a downward component force (toward the motor) with respect to the rotation axis A1 is generated on the inclined surface (136, 176) due to the airflow generated by rotation of the rotor, and thereby it is possible to stabilize the rotation of the shell and inhibit occurrence of self-excited vibration.

While the present invention has been described on the basis of examples, the present invention is not limited to the above-described examples and various modifications can be made without departing from the spirit and scope of the present invention. For example, a rotor having a shape different from the shape illustrated in the above-described examples or a swing rotor having a different shell shape can be similarly applied as long as the inclined surface can be formed on the vicinity of the upper outer edge. Also, a shape of the rotor cover is arbitrary, and when the portions indicated by the arrows 51*b* to 51*d* are not in a horizontal shape due to the annular horizontal portion 26*b* as illustrated in FIG. 6, other shapes may be used as long as they are smoothly formed so as not to affect an aerodynamic force. Further, a rotor not using a rotor cover may be configured such that an inclined surface of the present invention is formed on the vicinity of an opening (outer diameter surface on an outer side or inner diameter surface on an inner side).

What is claimed is:

1. A rotor for being accommodated in a rotor chamber of a centrifuge, the rotor comprising:

a rotor body configured to hold a sample; and a rotor cover that covers an opening portion of the rotor body, wherein an inclined surface extending toward a radial outer side of an outer edge of an upper surface of the rotor cover and extending upward from the outer edge of the upper surface of the rotor cover is formed on the rotor body.

2. The rotor for the centrifuge according to claim 1, wherein the inclined surface is a continuous annular inclined surface curved toward an upper side thereof from a radial inner side toward the radial outer side.

3. The rotor for the centrifuge according to claim 2, wherein:

two or more holding portions of sample containers disposed obliquely at an angle with respect to a rotation axis are formed on the rotor body; and the inclined surface is formed on an outer circumferential side of an opening of the holding portions of the rotor body.

4. The rotor for the centrifuge according to claim 1, wherein the rotor cover which covers the opening portion of the rotor body includes a through hole provided at a center thereof, and wherein a shaft having a handle passing through the through hole is rotatably held by the rotor cover, and the rotor cover is fastened to a screw portion of the rotor body with a screw portion formed on a lower end of the shaft.

5. The rotor for the centrifuge according to claim 4, wherein:

an outer edge of an upper surface of the rotor cover has a planar portion; and the inclined surface is configured to be continuous with the planar portion.

6. The rotor for the centrifuge according to claim 4, wherein:

the rotor cover includes an extended portion extending toward an outer side of an outer edge of the opening portion of the rotor body; and the inclined surface is formed on the extended portion.

7. The rotor for the centrifuge according to claim 1, wherein:

the rotor body is configured by a swing rotor body attached with a swing bucket, and the rotor body comprises a shell, which accommodates the swing rotor body and has an opening on an upper side of the shell, wherein the inclined surface is formed on the shell such that the inclined surface extends toward a radial outer side of an outer edge of the opening of the shell and extends upward from the outer edge of the opening of the shell.

8. A centrifuge comprising:

a motor;

the rotor according to claim 1, wherein the rotor is adapted to be driven and rotated by the motor; and a rotor chamber accommodating the rotor.

9. A rotor for a centrifuge, wherein the rotor has a rotor body comprising:

a swing rotor body attached with a swingable bucket;

a shell accommodating the swing rotor body and having an opening portion at an upper side of the shell; and a shell cover covering the opening portion of the shell, wherein an inclined surface extending toward a radial outer side of an outer edge of the opening portion of the shell and extending upward from the outer edge of the opening portion is formed on the shell cover.

10. A centrifuge, comprising:

a motor;

the rotor according to claim 9, wherein the rotor is adapted to be driven and rotated by the motor; and a rotor chamber accommodating the rotor.

* * * * *